US009365811B2

(12) United States Patent
Bonsall et al.

(10) Patent No.: US 9,365,811 B2
(45) Date of Patent: Jun. 14, 2016

(54) MANUFACTURE OF COATED PARTICULATE DETERGENTS

(75) Inventors: Judith Maria Bonsall, Wirral (GB); Philip Ronald Moore, Wirral (GB)

(73) Assignee: Conopco Inc., Englewood Cliffs, NJ (US)

( * ) Notice: Subject to any disclaimer, the term of this patent is extended or adjusted under 35 U.S.C. 154(b) by 534 days.

(21) Appl. No.: 13/878,440

(22) PCT Filed: Aug. 10, 2011

(86) PCT No.: PCT/EP2011/063748

§ 371 (c)(1),
(2), (4) Date: Jul. 18, 2013

(87) PCT Pub. No.: WO2012/048926

PCT Pub. Date: Apr. 19, 2012

(65) Prior Publication Data

US 2013/0287940 A1 Oct. 31, 2013

(30) Foreign Application Priority Data

Oct. 14, 2010 (EP) ..... 10187494

(51) Int. Cl.

| | |
|---|---|
| ***C11D 17/00*** | (2006.01) |
| ***C11D 3/40*** | (2006.01) |
| ***C11D 1/66*** | (2006.01) |
| ***C11D 3/10*** | (2006.01) |
| ***C11D 3/22*** | (2006.01) |
| ***C11D 11/00*** | (2006.01) |
| ***C11D 17/06*** | (2006.01) |

(52) U.S. Cl.

CPC ..... *C11D 17/0039* (2013.01); *C11D 1/66* (2013.01); *C11D 3/10* (2013.01); *C11D 3/225* (2013.01); *C11D 3/40* (2013.01); *C11D 11/0088* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 2,480,579 | A | 8/1949 | Holuba | |
| 3,521,805 | A | 7/1970 | Ward | |
| 3,887,614 | A | 6/1975 | Susuki et al. | |
| 3,989,635 | A | 11/1976 | Toyoda | |
| 4,097,418 | A | 6/1978 | Rolfes | |
| 4,269,722 | A | 5/1981 | Joshi et al. | |
| 4,308,625 | A | 1/1982 | Kitko | |
| 4,664,817 | A | 5/1987 | Wixon | |
| 4,965,015 | A | 10/1990 | Heybourne | |
| 5,002,681 | A | 3/1991 | Wierenga et al. | |
| 5,332,518 | A | 7/1994 | Kuroda et al. | |
| 6,114,297 | A | 9/2000 | Yamaguchi | |
| 6,159,920 | A | 12/2000 | Ridyard | |
| 6,284,722 | B1 | 9/2001 | Yamaguchi | |
| 6,472,362 | B1 | 10/2002 | Appel et al. | |
| 6,521,583 | B1 | 2/2003 | James et al. | |
| 6,579,838 | B2 | 6/2003 | Housmekerides et al. | |
| 6,589,927 | B1 * | 7/2003 | Kott | C11D 1/22 510/357 |
| 6,596,683 | B1 | 7/2003 | Ebihara | |
| 6,653,269 | B2 | 11/2003 | Housmekerides et al. | |
| 6,730,652 | B1 | 5/2004 | Painter et al. | |
| 6,747,000 | B2 | 6/2004 | Pearce | |
| 6,846,795 | B2 | 1/2005 | Lant | |
| 6,858,572 | B1 | 2/2005 | Mort, III | |
| 7,022,660 | B1 | 4/2006 | Mort et al. | |
| 7,166,567 | B2 | 1/2007 | Schudel et al. | |
| 8,883,702 | B2 | 11/2014 | Bonsall et al. | |
| 2001/0053757 | A1 | 12/2001 | Mendez Mata et al. | |
| 2002/0198133 | A1 | 12/2002 | Behler | |
| 2003/0042167 | A1 | 3/2003 | Balz | |
| 2004/0011693 | A1 | 1/2004 | Prenger | |
| 2004/0198629 | A1 | 10/2004 | Raehse | |
| 2004/0235704 | A1 | 11/2004 | Wasserman | |
| 2005/0227890 | A1 | 10/2005 | Van Dijk et al. | |
| 2006/0019860 | A1 | 1/2006 | Cardozo | |
| 2006/0160717 | A1 | 7/2006 | Itakura | |
| 2008/0234168 | A1 | 9/2008 | Hamelin et al. | |
| 2009/0054292 | A1 | 2/2009 | Menge et al. | |
| 2009/0308414 | A1 | 12/2009 | Gibis | |
| 2010/0069282 | A1 | 3/2010 | Prabhat et al. | |
| 2010/0069283 | A1 | 3/2010 | Prabhat et al. | |
| 2010/0132704 | A1 | 6/2010 | Djinovic | |

FOREIGN PATENT DOCUMENTS

| | | |
|---|---|---|
| CN | 1122361 | 5/1996 |
| CN | 1149885 | 5/1997 |
| CN | 1245529 | 2/2000 |
| CN | 1256710 | 6/2000 |
| CN | 1276828 | 12/2000 |
| CN | 1311755 | 9/2001 |
| CN | 1474657 | 2/2004 |
| CN | 1912088 | 2/2007 |
| CN | 1916148 | 2/2007 |
| CN | 101213286 | 7/2008 |

(Continued)

OTHER PUBLICATIONS

Anonymous, Physical Properties in sugar esters, Physical Properties in sugar esters, Dec. 27, 2001, 1-3, .

(Continued)

*Primary Examiner* — Shamim Ahmed
*Assistant Examiner* — Bradford Gates
(74) *Attorney, Agent, or Firm* — Greenberg Traurig, LLP

(57) ABSTRACT

A process to manufacture large coated detergent particles having perpendicular dimensions x, y and z, wherein x is from 0.2 to 2 mm, y is from 2.5 to 8 mm, and z is from 2.5 to 8 mm the particles being substantially the same shape and size as one another and the uncoated core particles comprising at least 50 wt % of soluble surfactant, the process comprising the steps of suspending uncoated core particles in a fluidized bed and spraying onto the core particles an aqueous slurry of sodium carbonate in admixture with 0.6 to 3 wt % sodium carboxy methyl cellulose and drying to form the coated particles.

14 Claims, No Drawings

(56) References Cited

FOREIGN PATENT DOCUMENTS

| | | | |
|---|---|---|---|
| CN | 101426895 | | 5/2009 |
| DE | 4220649 | | 1/1994 |
| DE | 4313137 | | 10/1994 |
| DE | 19954959 | | 5/2001 |
| DE | 10044118 | | 4/2002 |
| DE | 202004006632 | | 9/2004 |
| DE | 102006034900 | | 1/2008 |
| DE | 102006034900 | A1 | 1/2008 |
| DE | 102008010085 | | 8/2009 |
| EP | 0057611 | A2 | 8/1982 |
| EP | 0388389 | | 9/1990 |
| EP | 0391087 | | 10/1990 |
| EP | 0846755 | | 6/1998 |
| EP | 0877079 | A1 | 11/1998 |
| EP | 0903405 | | 3/1999 |
| EP | 0962424 | A1 | 12/1999 |
| EP | 1081219 | A2 | 3/2001 |
| EP | 2166077 | A1 | 3/2010 |
| GB | 688752 | | 3/1953 |
| GB | 383637 | | 6/1958 |
| GB | 2076011 | | 11/1981 |
| GB | 2386130 | | 9/2003 |
| JP | 1144934 | | 6/1989 |
| JP | 06-087742 | B | 11/1994 |
| WO | EP0567140 | A1 | 10/1993 |
| WO | WO9325729 | | 12/1993 |
| WO | WO9528462 | | 10/1995 |
| WO | WO9842818 | | 10/1998 |
| WO | WO9932599 | | 7/1999 |
| WO | WO0053719 | | 9/2000 |
| WO | WO0078912 | A1 | 12/2000 |
| WO | WO2004022693 | | 3/2004 |
| WO | WO2006032327 | | 3/2006 |
| WO | WO2008090091 | A1 | 7/2008 |
| WO | WO2010069957 | | 6/2010 |
| WO | WO2010084039 | | 7/2010 |
| WO | WO2010122050 | A2 | 10/2010 |
| WO | WO2010122051 | A1 | 10/2010 |

OTHER PUBLICATIONS

Kilcast et al., Sensory perception of creaminess and its relationship with food structure, Food Quality and Preference, Jun. 20, 2002, 609-623, 13.
Nelen, Sucrose Esters, Emulsifiers in Food Technology, 2004, 131-161, Chapter 6, Blackwell Publishing Ltd, GB.
W. Herbst et al, Industrial Organic Pigments, Industrial Organic Pigments, Dec. 1992, Index, .
PCT International Search Report in PCT application PCT/EP2011/063748 dated Nov. 9, 2011 with Written Opinion.
European Search Report in EP application EP 10 18 7494 dated Mar. 4, 2011.
PCT International Search Report in PCT application PCT/EP2011/065149 dated Dec. 20, 2011 with Written Opinion.
European Search Report in EP application EP 10 18 7509 dated Mar. 16, 2011.
Co-pending Application: Applicant: Batchelor et al., U.S. Appl. No. 13/878,442.
PCT International Search Report in PCT application PCT/EP2011/065124 dated Jan. 20, 2012 with Written Opinion.
European Search Report in EP application EP 10 18 7495 dated Mar. 8, 2011.
Co-pending Applicant: Applicant: Keningley et al., U.S. Appl. No. 13/878,444.
PCT International Search Report in PCT application PCT/EP2011/065150 dated Dec. 16, 2011 with Written Opinion.
European Search Report in EP application EP 10 18 7511 dated Mar. 21, 2011.
Co-pending Application: Applicant: Batchelor et al., U.S. Appl. No. 13/878,447.
PCT International Search Report in PCT application PCT/EP2011/065152 dated Dec. 15, 2011 with Written Opinion.
European Search Report in EP application EP 10 18 7512 dated Mar. 23, 2011.
Co-pending Application: Applicant: Batchelor et al., U.S. Appl. No. 13/878,448.
PCT International Search Report in PCT application PCT/EP2011/065153 dated Dec. 5, 2011 with Written Opinion.
European Search Report in EP application EP 10 18 7513 dated Mar. 16, 2011.
Co-pending Application: Applicant: Batchelor et al., U.S. Appl. No. 13/878,450.
PCT International Search Report in PCT application PCT/EP2011/065154 dated Dec. 16, 2011 with Written Opinion.
European Search Report in EP application EP 10 18 7514 dated Mar. 23, 2011.
Co-pending Application: Applicant: Batchelor et al., U.S. Appl. No. 13/878,451.
PCT International Search Report in PCT application: PCT/EP2011/057309 dated Jul. 15, 2011 with Written Opinion.
European Search Report in EP application EP 10 18 7506 dated Mar. 16, 2011.
Co-pending Application: Applicant: Bonsall et al., U.S. Appl. No. 13/878,456.
PCT International Search Report in PCT application PCT/EP2011/057310 dated Sep. 14, 2011 with Written Opinion.
Co-pending Application: Applicant: Bonsall et al., U.S. Appl. No. 13/878,459, filed Apr. 9, 2013.
PCT International Search Report in PCT application PCT/EP2011/067735 dated Jan. 23, 2012 with Written Opinion.
European Search Report in EP application EP 10 18 7520 dated Mar. 7, 2011.
PCT International Search Report in PCT application PCT/EP2011/067159 dated Jan. 25, 2012 with Written Opinion.
European Search Report in EP application EP 10 18 7500 dated Mar. 28, 2011.

* cited by examiner

MANUFACTURE OF COATED PARTICULATE DETERGENTS

TECHNICAL FIELD

This invention relates to the manufacture of coated particulate detergents with a large diameter, a smaller thickness and a narrow particle size distribution.

BACKGROUND

Particulate detergent compositions with improved environmental profiles could, in theory, be designed by eliminating all components from the composition that provide limited, or no, cleaning action. Such compact products would also reduce packaging requirements. However, to achieve this objective is difficult in practice because the manufacture of particulate detergent compositions usually requires the use of components that do not contribute significantly to detergency, but are nevertheless included to structure liquid ingredients into solids, to assist with processing and to improve the handling and stability of the particulate detergent compositions.

In our pending applications, PCT/EP2010/055256 and PCT/EP2010/055257 we propose to solve these problems by manufacturing a new particulate detergent composition. In general, the manufacture is done using a process comprising the steps of drying a surfactant blend, extruding it and cutting the extrudates to form hard core particles with a diameter of greater than 2 mm and a thickness greater than 0.2 mm. These large core particles are then preferably coated, especially with an inorganic coating.

Compositions comprising at least 70 wt % of these coated large particles with extruded surfactant cores differ from prior art extruded detergent compositions in that they have little or no solid structuring material to harden or structure the surfactant core. Instead, they use blends of low moisture surfactants to give hardness. The choice of surfactant allows the particles to give good detergency even without any conventional detergent builder, thus eliminating the need for such builders in the particles. Although the extruded particles are hard enough to cut to the required shape without deformation, they are hygroscopic and would stick together if not coated. It is therefore advantageous to coat the core particles by spraying inorganic material, such as sodium carbonate, onto them, in a fluid bed. The combination of the coating and the large particle size (5 mm diameter) substantially eliminates any tendency to deform or cake and allows production of a novel free-flowing composition of larger than usual detergent particles with excellent smooth and uniform appearance. Surprisingly, despite their large volume and high density, the particles are fast dissolving with low residues and form clear wash liquors with excellent primary detergency.

In PCT/EP2010/055257 a coating of inorganic salt (sodium carbonate) is applied to a large detergent core by spraying on a solution of the sodium carbonate in a fluidised bed of the cores. Because sodium carbonate is not highly soluble the process requires a large volume of water to be driven off to create a 20 to 30 wt % coating on the water soluble detergent core. Care has to be taken not to dissolve the core. The sodium carbonate coating process described is thus both time consuming and energy intensive.

Although we have produced very successful coatings from solutions of sodium carbonate they can be slow to produce, due to the limits on carbonate solution strength and the consequent high volume of water that must be removed to obtain a significant level (e.g. >20 wt %) of coating on the detergent particles. Furthermore, the fluidisation process has to be very closely and carefully controlled to avoid quenching of the bed.

U.S. Pat. No. 6,596,683B (P&G) also describes a process in which an inorganic aqueous solution is used to spray coat a core particle comprising detergent. The core also comprises inorganic builder material. Perhaps because of this the examples attain coating levels of only 2 wt % from the solutions of sodium carbonate. This is consistent with the teaching in column 10 that the inorganic solution is applied at a maximum level of 6%. Due to the presence of builder in the core there is no motivation to increase the coating level above the 6% maximum.

US2004235704A (P&G) describes the coating of detergent granules in a fluidised bed. The fluidised bed may be operated at a flux number of at least 3.5. Upon drying, the resultant detergent particles are said to have improved appearance and flow properties. Preferred coatings are non-hydrating inorganic salts, particularly Burkeite. As with most prior art the base particle that is being coated is taught, in paragraph 68, to include builder. The example used a 25% solution of Burkeite to give a 4% coating.

U.S. Pat. No. 6,858,572B (P&G) discloses a process for preparing detergent particles comprising a particle core of a detergent active material. This particle core is then at least partially covered by a particle coating layer of a water-soluble inorganic material. Particularly preferred are non-hydratable inorganic coating materials including double salt combinations of alkali metal carbonates and sulphates (Burkeite). The process includes the steps of passing the particle core through a coating mixer such as a low speed mixer or fluid bed mixer and coating the particle core with a coating solution or slurry of the water-soluble inorganic material. In a preferred embodiment the coating mixer is a fluidized bed. To achieve best results the nozzle location is placed at or above the fluidised height of the particles in the fluidised bed. The objective appears to be to create particles that are the same size and as spherical as possible. The coating zone of the fluidized bed is followed by a drying zone and then a cooling zone. Example 1 sprays on a 28.5 wt % Burkeite, or equivalent, solution to form a 5% coating. Example 2 sprays on a 67% potassium citrate solution to make a 5% coating. The higher solution concentration in example 2 means that less water has to be evaporated than in example 1. However, the coated particles would be sticky unless an additional dry coating is added on top. There is no enabling disclosure for spraying a slurry.

U.S. Pat. No. 3,989,635A (Lion) discloses a process for improving granular detergents. In Example 9 particles are coated with a 15% solution of sodium carbonate added to a fluidised bed together with sodium carbonate powder. The resulting 1 wt % coating is half from the solution and half from the separately added solids. The disadvantage of separate solids addition is that they adversely affect the appearance of the coating and they do not have the expected benefit of reducing the drying time compared to adding the entire solids loading in solution as done in other prior art.

US2004198629A (Henkel) discloses a detergent particle encapsulated with an insoluble material. The encapsulation layer is formed of polyvalent metal salts of hydroxylated fatty acid having at least 12 carbon atoms (e.g. zinc rincinoleate). The encapsulation material is preferably applied in the form of an aqueous dispersion in a fluidized bed. An exemplified coating suspension consisted of 16 wt % titanium dioxide, 16 wt % PEG 12000, 1.5 wt % of a mixture of 50 parts by weight of zinc ricinoleate, 35 wt % of triple-ethoxylated lauryl alcohol and 15 wt % tetra (2-hydroxypropyl)ethylenediamine (Tegosorb conc 50), 0.5 wt % sodium carboxymethylcellulose and the remainder water. Although SCMC is thus present in example 1 it is absent from the similar suspension in example 2 and thus cannot be considered as an essential part of the suspending system. This is consistent with the understanding of the skilled worker that a suspending polymer is not normally needed when there are large amounts of surfactant in a slurry. Thus the skilled person would understand that the SCMC is probably added to suspend the titanium dioxide pigment. It is not essential (as is clear from example 2) because the nonionic surfactant does the same job. The same skilled worker would normally turn to a polymer such as acrylic maleic copolymer even if surfactant were present.

SUMMARY OF THE INVENTION

According to the present invention there is provided a process to manufacture coated detergent particles having a core and a coating, the coated detergent particles having perpendicular dimensions x, y and z, wherein x is from 0.2 to 2 mm, y is from 2.5 to 8 mm (preferably 3 to 8 mm), and z is from 2.5 to 8 mm (preferably 3 to 8 mm), and the uncoated core particles comprising at least 50 wt % of a soluble surfactant, the process comprising the steps of suspending uncoated core particles in a fluidised bed and spraying onto the core particles an aqueous slurry in which the slurry is sprayed at a temperature of at least 35° C., the aqueous slurry comprising: sodium carbonate in admixture with 0.6 to 3 wt % sodium carboxy methyl cellulose and drying to form the coated particles.

Preferably the slurry comprises 45 to 60 wt % sodium carbonate.

Desirably the maximum particle size of the slurry is 50 microns. The particle size may conveniently be controlled to this maximum by milling. Larger particles are difficult to spray and do not film form as effectively.

The spraying is preferably done by means of at least one spray head. The at least one spray head is preferably immersed in the fluidised surfactant particles to avoid spraying into free space in the fluidised bed.

Preferably the slurry is sprayed at a temperature of at least 45° C., more preferably at least 55° C. The temperature of the slurry must be kept elevated to keep it as a monohydrate. If it reverts to a less soluble form, large crystals of sodium carbonate may be formed which will cause problems for the subsequent spraying.

The fluidising air temperature preferably lies in the range 30 to 80° C. Most preferably, the fluidising air temperature preferably lies in the range 35 to 150° C.

The ratio of slurry addition rate to air flow rate is advantageously in the range 30 to 350 $m^3$ air per 1 kg slurry spray.

Also according to the invention there is provided a process to coat particles of extruded soluble surfactant comprising the steps of fluidising the particles of extruded soluble surfactant by means of an air current and then, while the particles of extruded soluble surfactant are in a fluidised state, spraying onto the particles of extruded soluble surfactant an aqueous slurry at a temperature of at least 35° C., the aqueous slurry comprising at least 33 wt % sodium carbonate and from 0.6 to 3 wt % of sodium carboxymethyl cellulose, the size of the sodium carbonate particles in the suspension is less than or equal to 50 microns.

The size of particles that are entrained in the aqueous slurry which is sprayed onto the particle is preferably less than 50 microns; this applies in particular to the sodium carbonate but also preferably to all entrained material in the aqueous slurry.

The slurry may comprise up to 60 wt % sodium carbonate, optionally in admixture with other soluble or insoluble inorganic materials.

The slurry may comprise at most 5 wt % surfactant, preferably less than 1 wt % surfactant and most preferably it comprises no surfactant.

For the surfactant containing core particles being coated LAS/Nonionic is generally less sticky, higher hardness, and more easily coated with a slurry than LAS/SLES/PAS. However the latter is of interest for high foam applications.

Silicate may be added to the coating slurry.

Spray coating using a slurry without any surfactant is not easy. Problems were encountered when a slurry was used. The slurry settled out, so it was not as concentrated as expected. The feed pipes and spray nozzles blocked as the slurry settled or dried up. Also, the slurry tended to spray dry before it could coat the particles in the fluid bed. All these problems were solved by using SCMC to aid suspension. Further improvements were made by milling the slurry and even further improvements by immersing the spray head in the fluidised bed. Preferably the coated detergent particles have a core to coating ratio of from 3 to 1:1, most preferably 2.5 to 1.5:1, for example 2:1.

DETAILED DESCRIPTION OF THE INVENTION

Sodium carboxy methyl cellulose (SCMC) is an ideal choice of polymer because it is a material already used in detergent formulations for other purposes. Thus it is not simply being added a processing aid that serves no other purpose. Such an addition of a polymer that does not contribute to cleaning would be against the principles of formulation of highly concentrated compositions that the inventors are working towards. Surprisingly we have found that other polymers that would satisfy the general formulation principles for highly concentrated particulate detergents, such as CP5, a polymer often used to assist with suspension of detergent slurries prior to them being spray dried, do not provide the same slurry suspension properties in the substantial absence of surfactant in the slurry, as is preferably the case with the present process.

Other materials that may be added to the slurry are silicate, fluorescer, dye, zeolite and pigment.

We found that slurries of carbonate are only stable above 35.4° C., otherwise solid hydrates are formed. Trace heating is required to keep the temperature elevated above 35° C. It is highly advantageous to keep the temperature elevated to avoid the formation of large crystals. Large crystals drop out of suspension causing blockages in the lines and the spray head.

Even an unrecrystallised slurry of sodium carbonate has been found to block the spray nozzles. This problem was solved by passing the slurry suspension through an inline Silverson mill to reduce particle size to less than or equal to 50 microns, allowing successful atomisation.

Spraying above the bed may allow the slurry to spray dry before it reaches the particles, this tendency may be partly resolved by spraying close to the bed (<250 mm) or, more preferably, by spraying within the bed, e.g. via a bottom spray.

The invention will now be further described with reference to the following non limiting examples.

Example 1

Coated large detergent particles are manufactured, following the process in PCT/EP2010/055256.

Surfactant raw materials were mixed together to give a 67 wt % active paste comprising 85 parts LAS (linear alkyl benzene sulphonate), and 15 parts Nonionic Surfactant. The raw materials used were:

LAS: Unger Ufasan 65

Nonionic: BASF Lutensol AO30

The paste was pre-heated to the feed temperature and fed to the top of a wiped film evaporator to reduce the moisture content and produce a solid intimate surfactant blend. The conditions used to produce this LAS/NI blend are given in Table 1.

TABLE 1

| | | |
|---|---|---|
| | Jacket Vessel Temp. | 81° C. |
| Feed | Nominal Throughput | 55 kg/hr |
| | Temperature | 59° C. |
| | Density | 1.08 kg/l |
| Product | Moisture(KF*) | 0.85% |
| | Free NaOH | 0.06% |

*analysed by Karl Fischer method

On exit from the base of the wiped film evaporator, the dried surfactant blend dropped onto a chill roll, where it was cooled to less than 30° C.

After leaving the chill roll, the cooled dried surfactant blend particles were milled using a hammer mill, 2% Alusil® was also added to the hammer mill as a mill aid. The resulting milled material is hygroscopic and was stored in sealed containers.

The cooled milled composition was fed to a twin-screw co-rotating extruder fitted with a shaped orifice plate and cutter blade. A number of other components were also dosed into the extruder as shown in Table 2.

TABLE 2

| | Example 1 |
|---|---|
| Extruder | Parts (final particle = 100) |
| LAS/NI mixture | 64.3 |
| SCMC | 1.0 |
| Perfume | 0.75 |

The average particle diameter (y and z) and thickness (x) of samples of the extruded core particles were found to be 4.46 mm and 1.13 mm respectively. The standard deviation was acceptably low.

Example 2 and Comparative Example A

The detergent particle cores produced in Example 1 were then transferred to an Agglomaster fluidised bed and sprayed with a slurry consisting of 49.5 wt % sodium carbonate, 49.5 wt % water and 1 wt % SCMC at 60° C. The coated cores had a carbonate coating applied to the LAS/NI cores made in Example 1. For comparison the same core particles were coated using a sodium carbonate solution, this is comparative example A.

Slurry Coating Process Conditions

Example 2

Air Inlet temperature range used: 35-70° C.

Product Temperature during process: 38-42° C.

Air Flow Rate (cold air): 850 to 926 $m^3$/hr

Slurry addition rate: from 70 g/min to 496 g/min

External atomised nozzle used: Spray systems 60100 fluid cap and 120 air cap

In-Line Silverson mill set at 2500 rpm

Trace heating on lines: 60° C.

Trace heating on vessel: 45° C.

Coating rate=5.291 kg cores/min for each 1% coating level achieved

Flux number greater than 3.5

Comparative Example A

LAS/NI crystals, 30% sodium carbonate solution

Final product carbonate coating on LAS/NI core

Solution Coating Process Conditions

Example A

Air Inlet temperature range used: 45-90° C.

Product Temperature during process: 35-47° C.

Air Flow Rate (cold air): 800 $m^3$/hr

Slurry addition rate: from 82 g/min to 427 g/min

Internal atomised nozzle used: Spray systems 40100 fluid cap and 1401110 air cap Trace heating on lines: 45° C.

Trace heating on vessel: 45° C.

Coating rate=2.703 kg cores/min for each 1% coating level achieved

Both Example 2 and comparative example A result in a carbonate coated core, however in the case of Example 2 the coating rate is nearly doubled.

Example 3 and Comparative Examples B and C

NALAS/NI Preferable Core to NALAS/PAS/SLES or Ammonium LAS/NI

When coating with an SCMC suspended slurry we have found that NaLAS/NI (Example 3) is superior to both NaLAS/PAS/SLES (B) and ammonium LAS/NI (C), especially at larger scale coating (10 kg scale). Without wishing to be bound by theory we believe that this is because the NaLAS/NI based core is harder—especially under warm humid conditions as found in a fluid bed coating equipment. Core softness and the associated stickiness has been found to cause the bed to collapse before the cores can be adequately coated if the coating rate is set to be acceptably high for a realistic commercial process. The skilled worker will be able to test if a core is hard enough to coat, using normal laboratory coating equipment.

Example 4 and Comparative Examples D and E With CP5

We made up 50 wt % sodium carbonate slurries suspended with SCMC (example 4) and with two levels of an alternative polymer, CP5 an acrylic maleic polymer used to suspend conventional detergent slurries from BASF (Comparative examples D and E). 60 mm depths of each slurry were added to test tubes and stored for 14 hours at 40° C. They were then removed from storage and the amounts of settling measured. Details and results are given in table 3.

TABLE 3

| | Example 4 | Comparative Example D | Comparative Example E |
|---|---|---|---|
| Sodium carbonate | 50 | 50 | 50 |
| SCMC | 1 | — | — |
| CP5 | — | 2 | 4 |
| Depth of bottom suspended layer (mm) | 45 | 25 | 30 |
| Depth of top clear liquid layer (mm) | 15 | 35 | 30 |
| Volume of suspended solids % | 75 | 43 | 50 |

In addition to the difference in static settling behaviour, we found that the SCMC sample was much easier to re-suspend. The CP5 comparative samples were both more compacted and therefore harder to re-suspend. This would be a problem in any practical process because whilst the storage tank can be kept in suspension by continuous stirring it is not so easy to prevent settling in feed lines and the ability to get the slurry material to re-suspend is advantageous.

The invention claimed is:

1. A process to manufacture coated detergent particles having a core and a coating, the coated detergent particles having perpendicular dimensions x, y and z, wherein x is from 0.2 to 2 mm, y is from 2.5 to 8 mm, and z is from 2.5 to 8 mm, and the uncoated core particles comprising at least 50 wt % of a soluble surfactant, the process comprising the steps of suspending uncoated core particles in a fluidised bed and spraying onto the core particles an aqueous slurry in which the slurry is sprayed at a temperature of at least 35° C., the aqueous slurry comprising: sodium carbonate in admixture with 0.6 to 3 wt % sodium carboxy methyl cellulose and drying to form the coated particles.

2. A process according to claim 1 in which the aqueous slurry comprises 45 to 60 wt % sodium carbonate.

3. A process according to claim 1 in which the maximum particle size of the slurry is at most 50 microns.

4. A process according to claim 1 in which the slurry is milled prior to spraying.

5. A process according to claim 1 in which the spraying is done by means of at least one spray head.

6. A process according to claim 5 in which the at Beast one spray head is immersed in the fluidised surfactant particles.

7. A process according to claim 1 in which the slurry is sprayed at a temperature of at least 45° C.

8. A process according to claim 1 in which the fluidising air temperature lies in the range 35 to 150° C.

9. A process according to claim 1 in which the ratio of slurry addition rate to air flow rate is in the range 30 to 350 $m^3$ air per 1 kg slurry spray.

10. A process to coat particles of extruded soluble surfactant comprising the steps of fluidising the particles of extruded soluble surfactant by means of an air current and then, while the particles of extruded soluble surfactant are in a fluidised state, spraying onto the particles of extruded soluble surfactant an aqueous slurry at a temperature of at least 35° C., the aqueous slurry comprising at least 33 wt % sodium carbonate and from 0.6 to 3 wt % of sodium carboxymethyl cellulose, the size of the sodium carbonate particles in the suspension is less than or equal to 50 microns.

11. A process according to claim 10 in which the slurry comprises up to 60 wt % sodium carbonate, optionally in admixture with other soluble or insoluble inorganic materials.

12. A process according to claim 1 in which the slurry comprises at most 5 wt % surfactant.

13. A process according to claim 1 in which the surfactant comprises a blend of linear alkyl benzene sulphonate (LAS) and ethoxylated alcohol nonionic surfactant.

14. A process according to claim 1 in which the slurry further comprises silicate.

* * * * *